United States Patent [19]

Mahaffy et al.

[11] Patent Number: 4,709,535

[45] Date of Patent: Dec. 1, 1987

[54] PACKAGING LOADER APPARATUS FOR SLICED FOOD PRODUCTS

[75] Inventors: Reid A. Mahaffy, Montclair, N.J.; Eugene Garson, Bronx, N.Y.; Milan R. Ostrow, Pequannock, N.J.

[73] Assignee: Mahaffy & Harder Engineering Co., Fairfield, N.J.

[21] Appl. No.: 850,940

[22] Filed: Apr. 11, 1986

Related U.S. Application Data

[63] Continuation-in-part of Ser. No. 724,404, Apr. 18, 1985, abandoned.

[51] Int. Cl.[4] ..... B65B 5/06; B65B 39/00

[52] U.S. Cl. ..... 53/473; 53/247; 53/252

[58] Field of Search ..... 53/55, 157, 235, 247, 53/251, 252, 473, 475, 493, 248, 260, 261, 262

[56] References Cited

U.S. PATENT DOCUMENTS

| | | | |
|---|---|---|---|
| 1,962,651 | 6/1934 | Wall | 53/157 X |
| 2,319,167 | 5/1943 | Stewart | 53/248 X |
| 3,180,066 | 4/1965 | Mahaffy et al. | 53/252 X |
| 3,585,785 | 6/1971 | Smith | 53/252 |
| 3,673,756 | 7/1972 | Prete et al. | 53/248 X |
| 3,708,947 | 1/1973 | Green et al. | 53/55 |
| 3,778,965 | 12/1973 | O'Lenick et al. | 53/248 |
| 3,893,282 | 7/1975 | Armbruster et al. | 53/252 |
| 4,048,784 | 9/1977 | Toby | 53/248 X |
| 4,478,024 | 10/1984 | Vedvik et al. | 53/247 X |
| 4,494,355 | 1/1985 | Johnson et al. | 53/247 X |

*Primary Examiner*—Horace M. Culver

*Attorney, Agent, or Firm*—Parmelee, Bollinger & Bramblett

[57] ABSTRACT

Apparatus for automatically loading stacks of sliced food products into package receptacles. The sliced food products are transported from a first conveyor to a loading station having a drop station positioned over and aligned with a series of package receptacles which are indexed intermittently through the loading station. A retractable pusher arm having a pusher mounted thereon is driven in the loading station to engage and sweep a stack of sliced product into the drop station, and then is retracted and returned to its initial ready position to perform the next sweeping action on a subsequent stack of sliced food product. A ram is mounted in the drop station in a normally inactivated position over the stack of sliced product when the product is swept therein by the pusher. The ram is actuated to force the stack of sliced product through the drop station into the package receptacle, and then is returned to its initial inactive position awaiting the arrival of the next stack of sliced product at the drop station.

23 Claims, 10 Drawing Figures

PACKAGING LOADER APPARATUS FOR SLICED FOOD PRODUCTS

This application is a continuation-in-part of application Ser. No. 724,404 filed on Apr. 18, 1985 by applicants herein and now abandoned.

BACKGROUND OF THE INVENTION

1. Field of the Invention

This invention relates to packaging apparatus. More particularly, this invention relates to apparatus for loading stocks of perishable food product automatically into thermoformed plastic package portions while the package portions are in a loading station of a packaging machine.

2. Description of the Prior Art

One type of thermoforming and vacuum sealing packaging machine used for packaging perishable sliced food products is illustrated in U.S. Pat. No. 3,061,984. This machine comprises an endless train of trays each having two side-by-side cup-shaped forming dies which are indexed through a series of packaging stations at which successive operations are performed. As shown in the patent, the machine thermoforms one of two webs of packaging material into cup-shaped receptacles in the trays and then indexes the trays past an open area where the product groups to be packaged are inserted by hand. At the time of product loading, the cup-shaped thermoformed package portions are still held in a nested relation in the tray where they were originally formed.

A second type of thermoforming and vacuum sealing machine that is widely used in industry for packaging this class of products is illustrated in U.S. Pat. No. 3,498,021 which differs from the type previously described by having non-indexing thermoforming dies at one position, an open area for product loading, and a second set of dies which are used for evacuation and sealing. In this latter type of machine, the thermoformed web is indexed through the machine only by chains with film clamps at the two edges of the web, and may also be supported by stationary rails extending in the direction of movement. In this type of packaging machine, it may be advantageous to add a vertically reciprocating mechanism with dies to engage and support the thermoformed cups during the loading operation. It is an object of this invention to provide superior automatic loading apparatus for both types of machines described above as well as for other types not described herein.

During the early development of vacuum packaging machines of the thermoforming type, it was common practice to use only extremely thin and flexible packaging materials, at least for those portions of packages which were thermoformed into receptacles to accept the products. Thus, under vacuum, atmospheric pressure action on the outer surfaces of all sides of such packages forced the packaging materials into intimate contact and close shape conformity with the product or product groups inside. For this reason, and because of the extreme flexibility of the materials, these packages could be thermoformed considerably oversize as compared to the products without unduly stressing the packaging materials or putting undue stresses on the seals when the packages were completed. Of course, it was also relatively easy to load stacks of thinly sliced luncheon meats and like comestables into these oversized formations. Also, there was little demand during these early years for nearly perfect package appearance, and significant stacking errors and considerable product disarray were considered acceptable.

During recent years, however, two package characteristics have emerged as highly desirable or even mandatory. The first new demand was for packages having thermoformed portions made of significantly thicker and more rigid material. These packages were capable of providing spectacularly improved appearance together with enhanced user acceptance due to easier opening characteristics, the capability of reclosability, and other factors. It was quickly discovered, however, that these advantages could be obtained only by very careful control of product size, so as to provide accurate fit in the package, and by very accurate stacking of sliced products. Thus, the loose fitting, oversized, thermoformed cups and inaccurately sized products which were common practice when using flexible packages became unacceptable. As one result, hand loading of the product became more difficult, and often required much product rearrangement and manipulation by operators. The problem could not be alleviated by use of oversized formations of semi-rigid material because such packages under vacuum still collapse completely, or virtually completely, against the products, and result in very bad package appearance, often accompanied by frequent package leakage and breakage of seals.

Meat packers had been aware for some time, even prior to the introduction of semi-rigid vacuum packaging, that bacterial contamination during the slicing and packaging operations was a major cause of shortened shelf life. This contamination is caused primarily by difficult-to-clean machinery which contacts the product, and by close proximity with and/or manual handling by human operators. Thus, it is highly desirable to provide automatic loading apparatus not involving any significant human handling procedures.

SUMMARY OF THE INVENTION

The apparatus of the invention was developed with the objectives of greatly reducing product handling by operators through fully automatic loading and of providing machinery for this purpose which is simple and easy to keep clean. The substantial difference between the apparatus of the invention and prior art apparatus may be better appreciated by comparision with the apparatus shown in U.S. Pat. No. 3,180,066, which was the most successful of the prior art systems for the intended products.

In accordance with another aspect of the invention, apparatus is provided which is capable of loading relatively warm, very flexible, relatively thinly-sliced and stacked luncheon meat products into new closely-fitted, semi-rigid package cavities reliably and without disruption, at high speeds, e.g. at and above 100 packages per minute (50 cycles per minute, 2 packages per cycle).

The earlier automatic loader built in accordance with the aforementioned U.S. Pat. No. 3,180,066 included a pair of spring-loaded horizontal trap doors through which the product was pushed by a means of a power-actuated ram down into a waiting receptacle. This loader was relatively successful in terms of being capable of loading thinly sliced stacks of very flexible product at moderate speeds, but was capable of loading product only into oversized flexible package formations. In considering such apparatus, it was discovered that sideways displacements of the product element (i.e.

inaccuracies in the crossmachine direction) often occurred, thus preventing loading into close-fitting packages with apparatus of the prior art type.

The product displacement described above was found to result from unequal rotational spring resistances in the two trap doors in the drop station. The springs in these devices were built in, and inaccessible for replacement, and no means were provided for adjustment (although it was known that spring adjustment would be desirable when changing, for instance, from a heavy to a light stack).

It was further found that better product placement in the cross-machine direction would result by assuring coincidental and equal angular displacemt of the two trap doors, even though the spring forces on the doors might not be exactly equal. Thus, in one further aspect of the present invention, coordination of angular movement of the two trap doors has been provided. In another aspect, ready adjustment of the spring force has been provided.

It also has been found desirable to minimize the vertical distance between the product position on the trap doors of the drop mechanism and the tray and/or the formed package portion into which the product is to be loaded. Ideally this distance should be no greater than the distance resulting from the swinging of the trap doors, plus a little clearance. It has been found that this ideal can be achieved (or almost so) by employing an inclined conveyor which moves the product down along a ramp-like path to the loading station. Such a configuration especially is advantageous because it avoids interference with apparatus which occupies the space above the formed web line immediately preceding the loading position in packaging machines of this general type.

It also has been found desirable to simplify the loading mechanism and to make it easier to keep clean. In one respect, this has been achieved by replacing the overhead chains of apparatus as shown in U.S. Pat. No. 3,120,066 with a simple reciprocating overhead pusher arm (to be described hereinbelow) designed to engage and accelerate each product group into the drop position on the trap doors The downwardly sloping conveyor is arranged in the form of an elongate inclined "S" to convey the stacks of product from a higher horizontal path to the lower horizontal position of the trap doors. The lower sweep of the "S" advantageously is formed in the configuration of an approximate radius swing around the center of rotation of the overhead arm. In this way the desirable features of a lower horizontal position at the drop position and a simplification of the apparatus were met by the novel combination of a swinging arm and an inclined conveyor path, especially having an appropriately curved portion adjacent the path of the pusher arm.

Smaller and simpler apparatus with fewer product contacting surfaces is inherently easier to keep clean, but additional measures to promote frequent and thorough sanitization have been taken in the design of the apparatus such as easily removable ram pads, easy removable inclined conveyor, and tiltable infeed conveyor. In addition, the major portion of the automatic loader is arranged to be moved to the rear by sliding on rails for thorough cleaning and other maintenance as required.

All major motions of the apparatus are positively driven in order to insure positively controlled accelerations and decelerations for maximum speed and repetitive accuracy. Only the product-engaging faces of the pusher arms are pneumatically moved to and from engaging position because this design is extremely simple and the timing of the motion is less critical than others.

Of all the automatic loading apparatus known to exist, only the disclosed apparatus has performed satisfactorily for loading stacks of flexible, thinly sliced luncheon meats under typical factory conditions. Other apparatus as disclosed in U.S. Pat. No. 4,478,024 is intended to be used for generally similar product formulations, but in a different condition, e.g. as described in the specification of that patent as "cut from a large frozen loaf", hence relatively rigid and stiff. The apparatus of this referenced patent is claimed to be capable of aligning the slices in each stack. However, most sliced meat manufacturers do not, for various reasons, wish to slice and package product in a sufficiently cold condition to enable the slices to slide on each other for purposes of automatic alignment. In fact, no automatic apparatus has yet been developed, insofar as is known, which is capable of aligning the slices in stacks of product typical of those for which the apparatus of the present invention is intended, i.e. relatively warm, very flexible, relatively thinly-sliced and stacked luncheon-meat products.

Other objects, aspects and advantages of the invention will in part be pointed out in, and in part apparent from, the following description of one preferred embodiment of the invention, considered together with the accompanying drawings.

DESCRIPTION OF A PREFERRED EMBODIMENT

Figure 1:
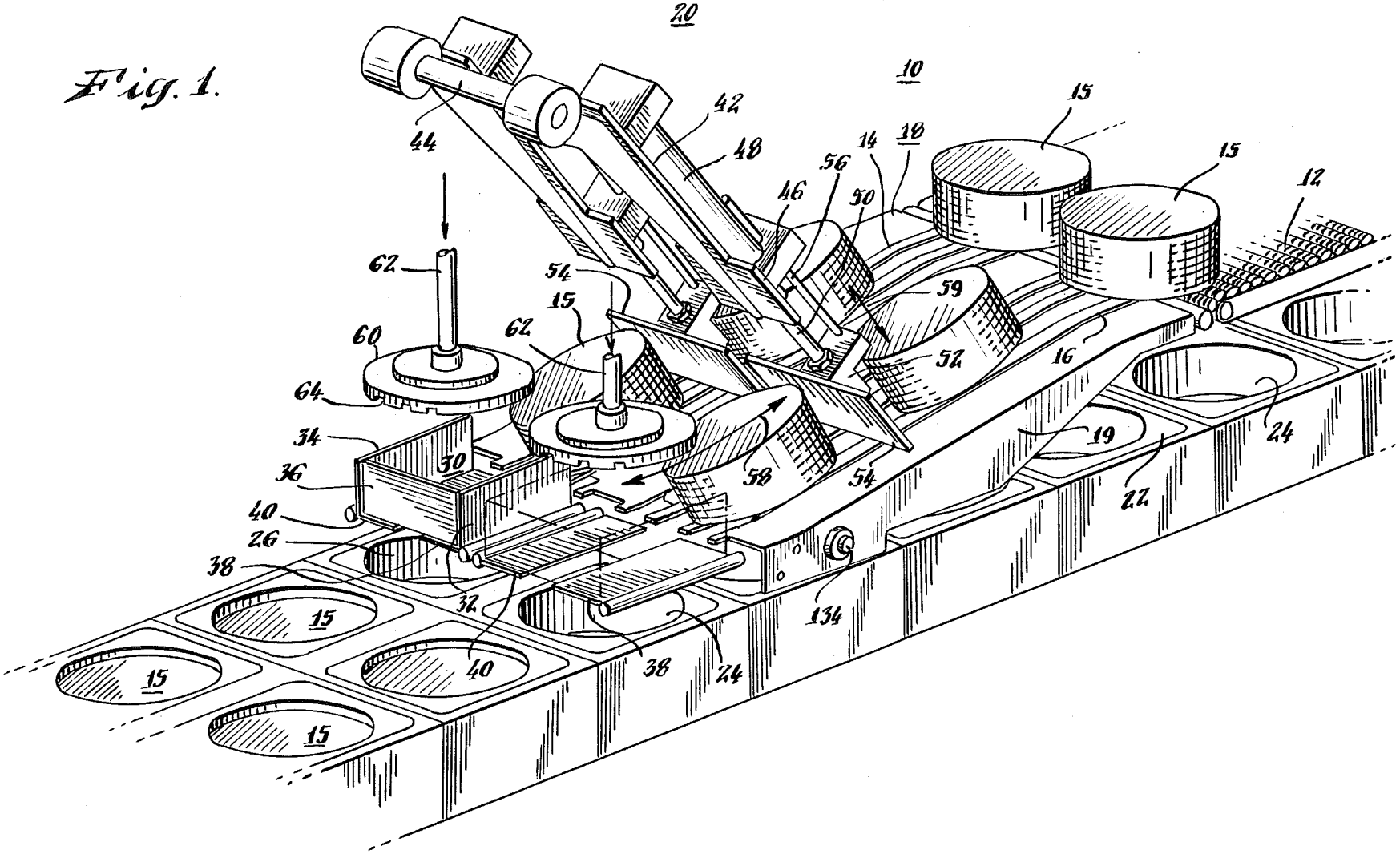
FIG. 1 is a perspective view of a portion of a packaging machine in accordance with the present invention, particularly showing, the loading station.

Referring now to FIG. 1, there is shown a portion of a packaging machine, referred to generally with the reference number 10. The machine 10 includes a horizontal in-feed conveyor 12 of stainless steel mesh carrying stacks of sliced food product such as luncheon meats. The stacks of sliced food products are arranged in two parallel rows. The conveyor 12 deposits the stacks on sets of belts and 16 forming a downwardly-inclined conveyor generally indicated at 18.

The belts 14 and 16 each comprise three parallel strips made, for example, of polyurethane. The under surfaces of these strips advantageously are formed with teeth to provide a positive belt drive by sprockets for each of the strips. The belts slide upon a stainless steel conveyor bed 19 which may, for example, be angled downwardly at an angle of about 12° . The driven flexible belts deliver the stacks 15 of sliced product to a loading station generally indicated at 20.

The packaging machine 10 is of the type having an endless train of packaging trays 22 forming side-by-side die cavities 24 and 26. These trays are indexed through a series of packaging stations including the loading station 20. The dwell time between each indexing step provides for the carrying out of different packaging operations at the various stations while the trays are stopped. The drive for the conveyors and the automatic loader is furnished by a conventional mechanism such as one similar to that disclosed in the aforesaid Mahaffy U.S. Pat. No. 3,180,066. Cup-shaped receptacles are formed with trays 22 by vacuum-forming a web of thermoformable plastic in known fashion down into the tray cavity.

The loading station 20 comprises a pair of side-by-side drop stations 30, each with identical mechanisms. Accordingly, only one of these stations and its mechanism will be described in detail.

Each drop station 30 comprises side walls 32 and 34, a rear wall 36, and pivotal spring-biased trap doors 38 and 40. The trap doors have a sufficient spring bias thereon to hold a stack 15 of food products which is to be packaged until the stack is driven down into the waiting receptacle beneath the trap doors, as will be described in detail hereinafter. The side walls 32 and 34 guide the stack 15 into the drop station 30, and the rear wall 36 aids the side walls in properly positioning the stacks 15 over the trap doors so that stacks can be loaded into the waiting receptacles when the trays are stopped.

Each loader includes a swinging pusher arm 42 mounted on an oscillating shaft 44. The pusher arm 42 has a mounting plate 46 thereon which carries an air cylinder 48 and its operating rod 50. The operating rod 50 is operable with a bracket 52 carrying a pusher 54 and a guide rod 56 which is adapted to slide up and down in the mounting plate 46 for stabilizing the movement of the retractable pusher 54. The retractable pusher 54 moves up and down in oscillatory fashion as indicated by the arrow 59 in FIG. 1

The pusher 54 sweeps the stack of product 15 into the drop station 30 on the forward motion of the pusher arm 42, and then is retracted up and back over a subsequent stack. It is thereafter again lowered and moved forward to sweep the next stack into the drop station 30.

Each loader also includes a ram 60 which is secured to and operated by a shaft 62. The lower face of the ram 60 has grooves 64 therein for limiting surface contact of the ram with the top slice of the stack 15 so that the top slice will not adhere to the surface of the ram when the ram 60 is retracted.

Figure 2:
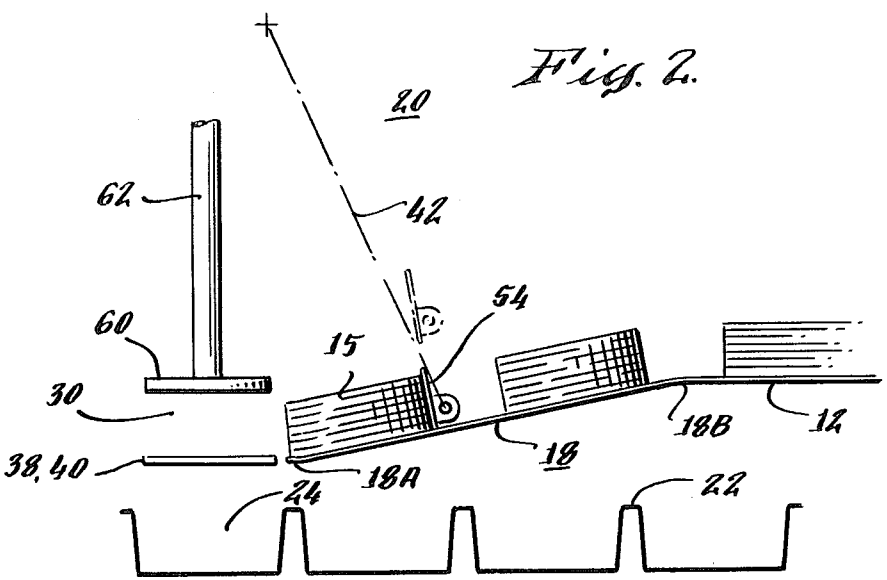
Figure 5:
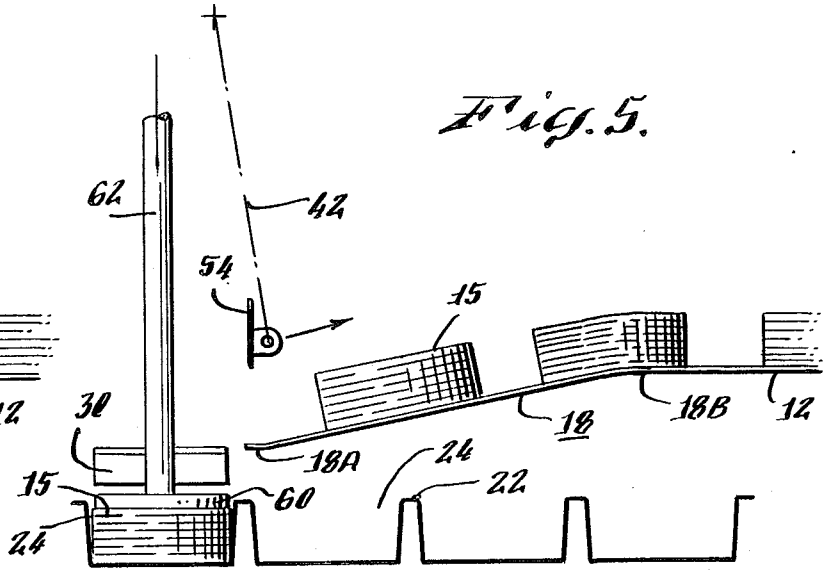

Referring now to FIGS. 2 through 5, the stacks 15 of sliced product are moved from the horizontal conveyor 12 to the downwardly inclined conveyor 18 and onto the trap doors 38 and 40. In FIG. 2, one tray 22 is shown in position in the drop station 30 with the cavity 24 aligned under the drop station to receive a stack of sliced product. The pusher arm 42 is at the end of its return sweep and the pusher 54 is shown in phantom in its vertically retracted position. The air cylinder 48 thereafter is actuated to move the pusher 54 directly down and behind the next stack 15 as shown in solid lines.

Figure 3:
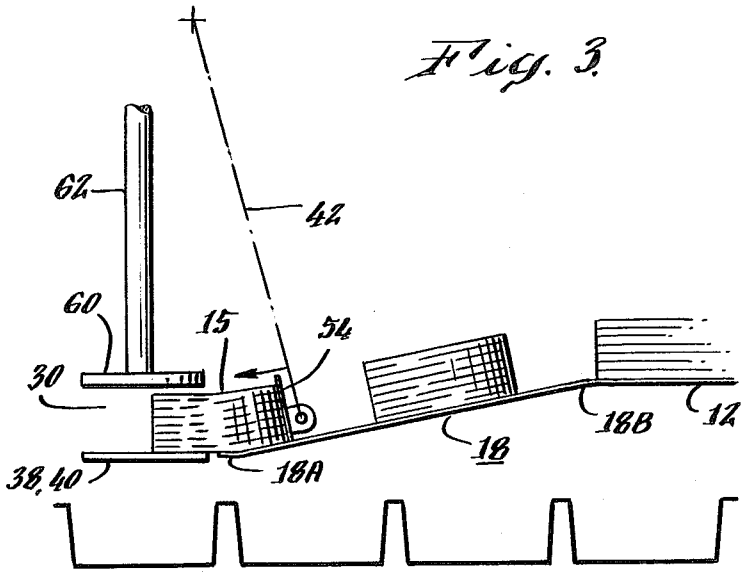
FIGS. 2–5 are schematic diagrams illustrating the sequence of operations performed by the automatic loader when loading sliced products.

FIG. 3 illustrates the pusher 54 moving a stack 15 towards the drop station 30 as the pusher arm 42 swings about its axis. The downwardly-swinging arcuate path of the pusher 54 follows approximately the downwardly-inclined path of the conveyor 18 so as to provide for effective loading movement. Preferably, the conveyor (i.e., the conveyor bed 19) is arcuately curved at its lower end 18A to provide smooth support for the stack during transfer. Ideally, this arcuate curvature 18A matches the arcuate path of the pusher, but in practice the conveyor radius-of-curvature may be less than the radius of the pusher arm 42. The conveyor may also be convexly-curved at its upper end 18B to provide a smooth transition from the horizontal conveyor 12 to the inclined conveyor 18, i.e. without significant discontinuity.

Figure 4:
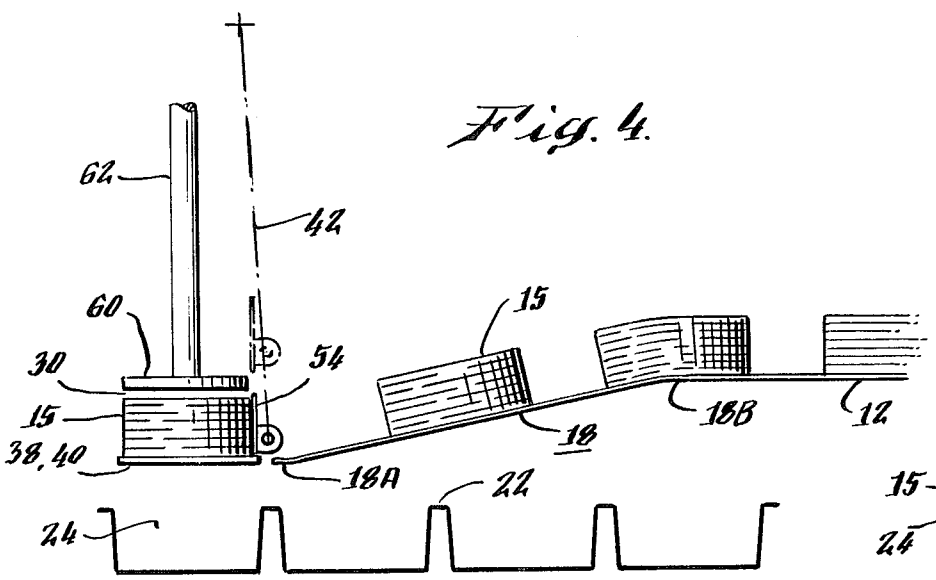

In FIG. 4, the pusher arm 42 has reached the end of its forward sweep, and the stack 15 has been moved onto the trap doors 38, 40. The pusher 54 is then retracted as shown in phantom. As the operation continues in FIG. 5, the shaft 62 forces the ram 60 downward to press the stack 15 through the trap doors of the drop station into the cavity 24 of the tray 22. At the same time, the pusher arm 42 with its retracted pusher 54 is swinging back behind the next stack 15. The shaft 62 then removes the ram 60 from the cavity 24 back up through the drop station, and the trays 22 are indexed forward with the next die cavity 24 being positioned under the drop station 30 as depicted in FIG. 2. This process repeats at a relatively high speed such as 100 package loadings per minute for two drop stations.

As shown in FIGS. 2 through 5, the spacing between consecutive stacks 15 is substantially greater than the spacing between consecutive die cavities 24. Such wider stack spacing is selected to allow sufficient room to assure proper insertion of the pusher 54 between the stacks at the start of a sweep movement towards the drop station 30. However, the system is so arranged as to provide for exact synchronization between the arrival of the stacks and the arrival of the die cavities at the drop station. For that purpose, the conveyor 18 (and the conveyor 12) is operated at a lineal speed which is greater than the average speed of the trays 22.

For example, in one commercial embodiment having a center-to-center die spacing of 5.25", the center-to-center stack spacing (nominal) was 7". That is, the stacks moved forward at a rate of 7" per machine cycle, providing a relative stack-to-die speed ratio (on average) of $7 \div 5.25$, or about 1.34. With luncheon meat having a diameter of 4.5", the spacing between consecutive stacks was 2.5", which is sufficient to assure reliable operation of the automatic loader.

Figure 6:
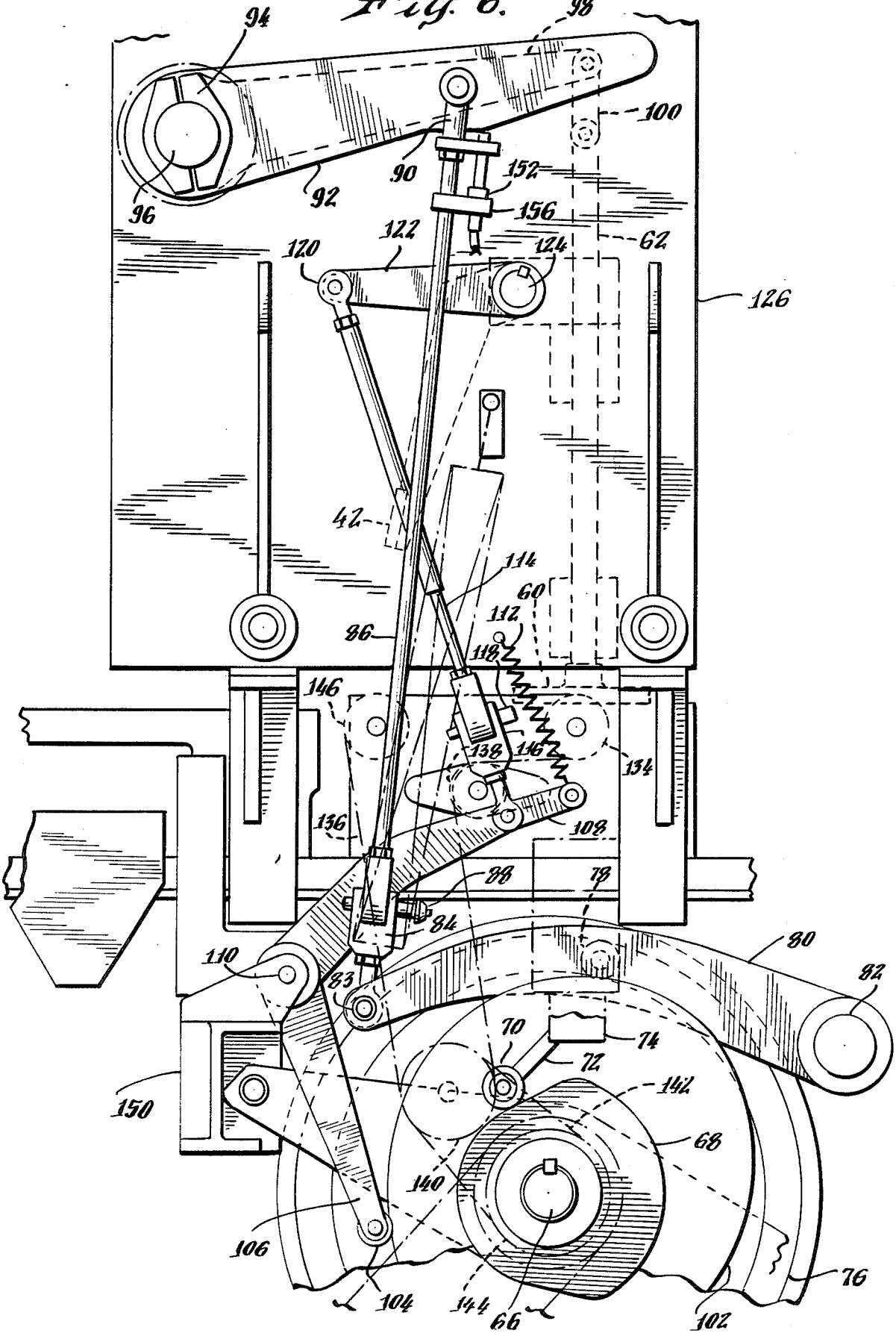
FIG. 6 is a side elevation view illustrating the drive mechanisms.
Figure 7:
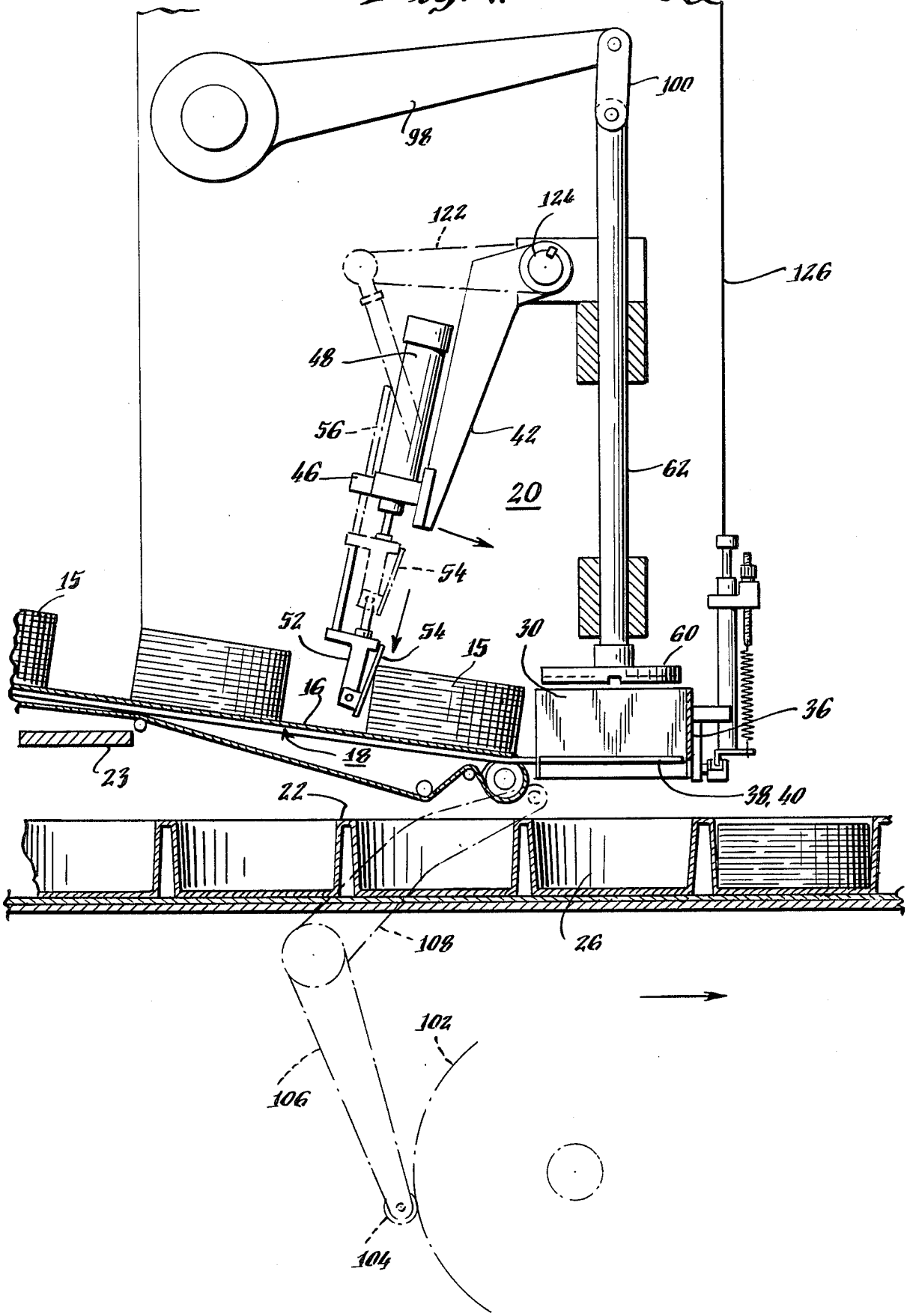
FIG. 7 is a side elevation view of the loading station showing the ram and sweeper arm.
Figure 8:
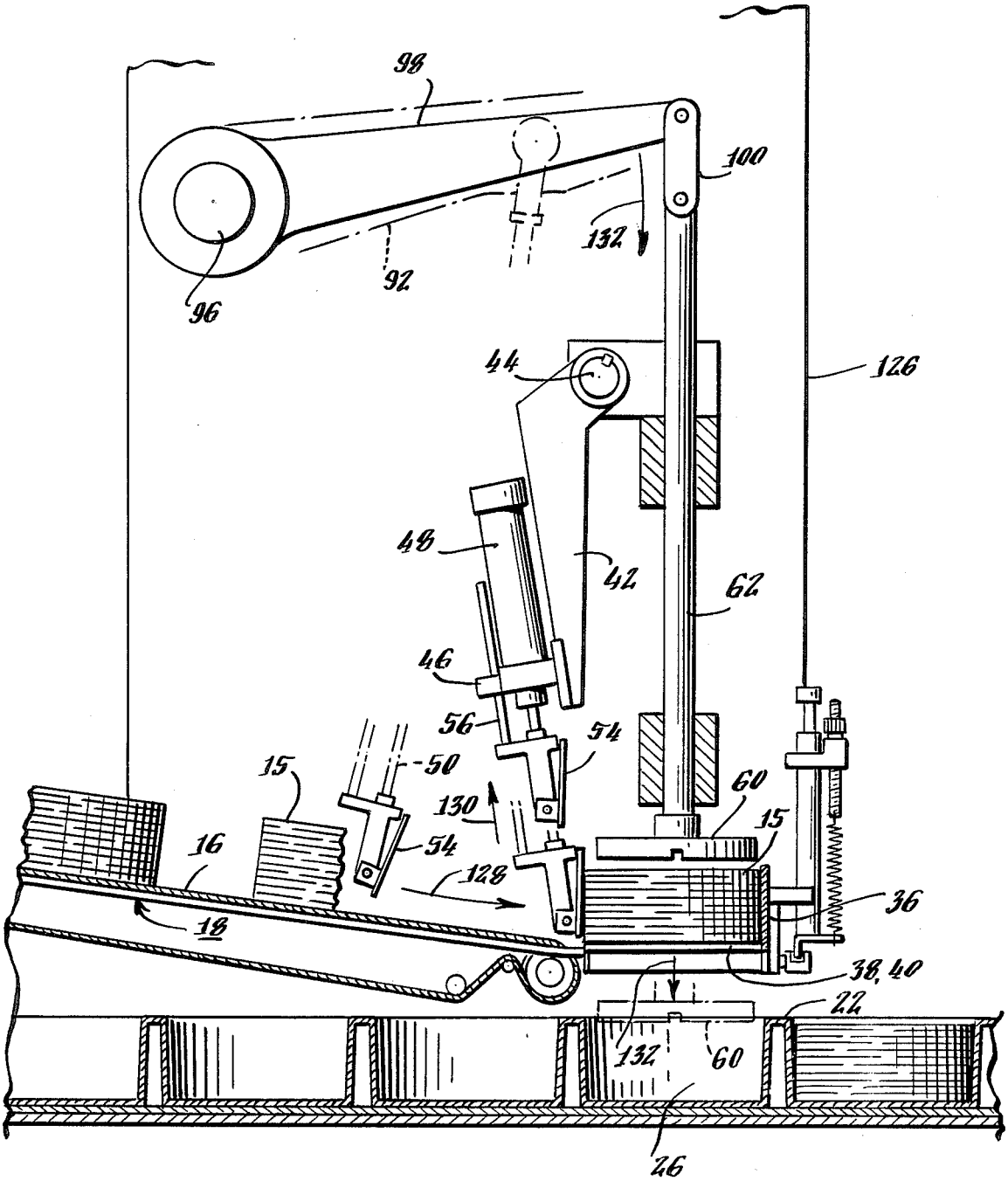
FIG. 8 is a view similar to FIG. 7 illustrating the sweeping action of the pusher.

Referring now to FIG. 6, the sweep action of the pusher arm 42, and the actuation of the ram 60 are controlled from a common drive shaft 66 which is rotated by the machine drive (not shown). A cam 68 is mounted on the drive shaft 66 and is provided with a cam follower 70 having a link 72 coupled to a control switch 74 for the air cylinder 48 to control the position of the retractable pusher 54. FIG. 7 illustrates the downward movement of the pusher 54 on actuation of the control switch 74 while FIG. 8 illustrates the action of the pusher at the forward end of the sweep path of the pusher arm 42, thereby elevating the pusher for its rearward movement to a position to pick up the next stack 15 from the conveyor 18.

One advantage of providing a downwardly-inclined conveyor 18 is that it prevents interference with packaging equipment positioned above the trays 22, as illustrated symbolically at 23 in FIG. 7. Such equipment may for example be a deep-forming plug-assist attachment as known in this art. The inclined conveyor allows such equipment to be employed while achieving a minimal drop distance for transferring the stacks 15 to the die cavities 24.

Returning to FIG. 6, a large box cam 76 is mounted on the drive shaft 66 and carries a cam follower 78. This follower is pinned to a crank arm 80 which pivots about a shaft 82 on one end thereof. The other end of the crank arm 80 is secured by a pin 83 through a clevis 84 having a rod 86 mounted therein by a pin 88. The rod 86 is coupled by a coupling line 90 to a rocker arm 92 which is secured by a clamp 94 to a pivot shaft 96. This shaft carries an actuating arm 98 which is coupled on the other end thereof to a link 100 for driving the rod 62 which carries the ram 60.

The movement of the pusher arm 42 is controlled by a pusher arm cam 102 the movement of which is tracked by a cam follower 104 carrying a first arm 106 and a second arm 108 with the first and second arms forming a crank lever having a pivot mounting 110. The other end of the second arm 108 of the crank lever has a spring 112 connected thereto which functions to maintain the cam follower 104 on the pusher arm cam 102. The second arm 108 of the crank lever has a rod 114 connected thereto through a clevis 116 carrying a pin 118 for attaching the rod 114 to the second arm 108. The clevis pin arrangement as well as an adjustable rod 114 provides an adjustment for the position of the sweep. The rod 114 is connected by a link 120 to an arm 122 which is mounted on a pivot shaft 124. The pivot shaft 124 also carries the pusher arm 42 (see FIG. 7). Providing pairs of arms (92, 98; 42, 122) on the respective pivot shafts (96; 124) allows separation of the individual arms by a wall 126 extending parallel to the direction of movement of the trays 22. This serves to isolate most of the machinery and moving parts from exposure to the food which is packaged on the opposite side of the wall 126 from the side shown in FIG. 6. This will be apparent from viewing FIG. 7 in which the machinery illustrated in FIG. 6 is isolated from the food loading side of the loader station 20.

As will best be seen in FIG. 7, the cam 102 controls the sweeping motion of the pusher 54 which is attached to the pusher arm 42. The pusher arm and its attached pusher is shown at the end of its return path with the retractable pusher illustrated in phantom above the space between the stacks 15, and then in solid line in its lower position engaging the forward stack to push it towards the drop station 30. In FIG. 8, the pusher and its support mechanism 54 is shown in fragmentary form at the end of its forward movement indicated by the arrow 128 to deliver the stack 15 into the drop station; thereafter, the pusher is retracted upwardly in the direction of the arrow 130, as shown in full outline. The ram cam 76 thereafter acts through its follower 78 and crank arm 80 to actuate the control arm 98 to move the shaft 62 downward in the direction shown by the arrow 132 to force the stack 15 through the trap doors 38, 40 to the cavity 26 of the trays 22.

Returning to FIG. 6, the drive shaft 66 is rotated by the machine drive, and drives the conveyors for the automatic loader. The loader drive shaft 134 is driven by the drive shaft 66 by a chain 136 which passes over an idler sprocket 138 and over a sprocket 140 driven by a chain 142 passing over a sprocket 144 which turns with the drive shaft 66. The chain 136 is returned from the sprocket 140 over another sprocket 146.

A sensor 152 is mounted on a bracket 156 which moves with the rod 86. If the ram 60 gets stuck or its controlling arm 98 gets jammed and does not move, relative motion between the sensor probe and its target will occur so as to provide a signal that stops the machine.

Figure 10:
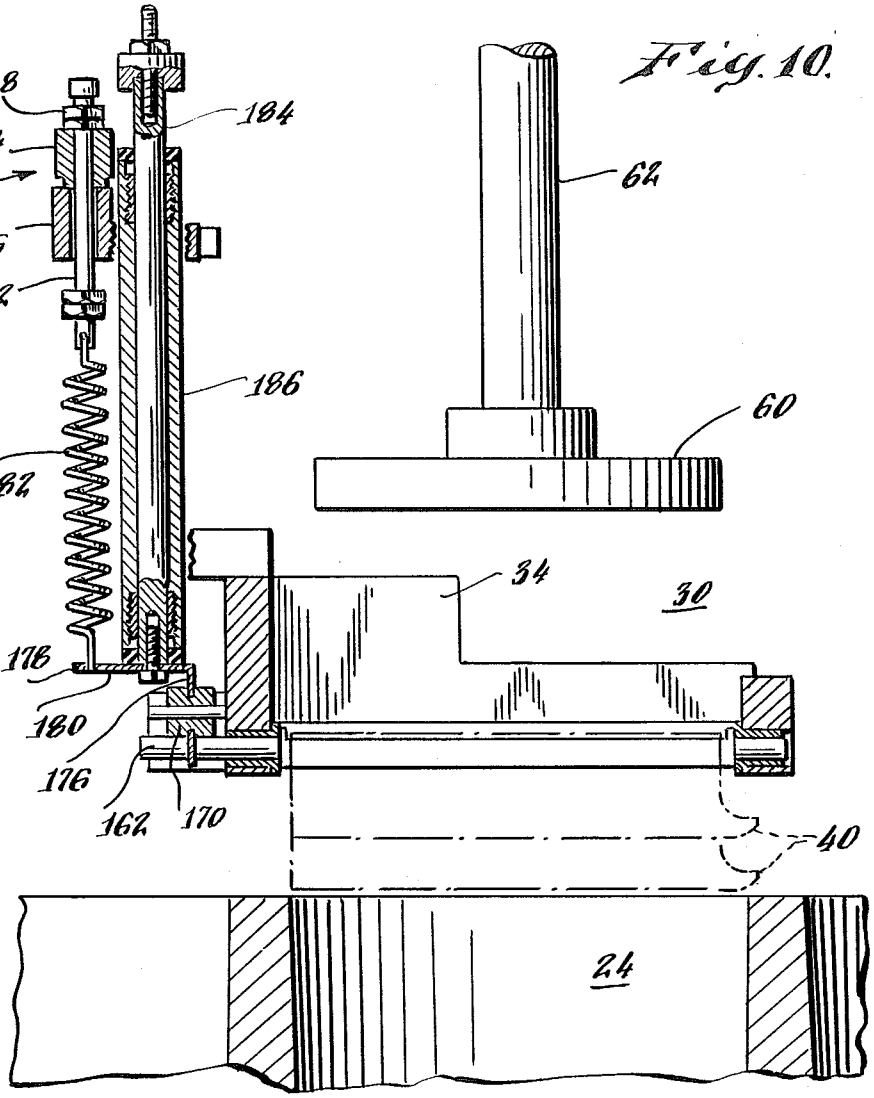
FIG. 10 is a side elevation view of the mechanism shown in FIG. 9.
Figure 9:
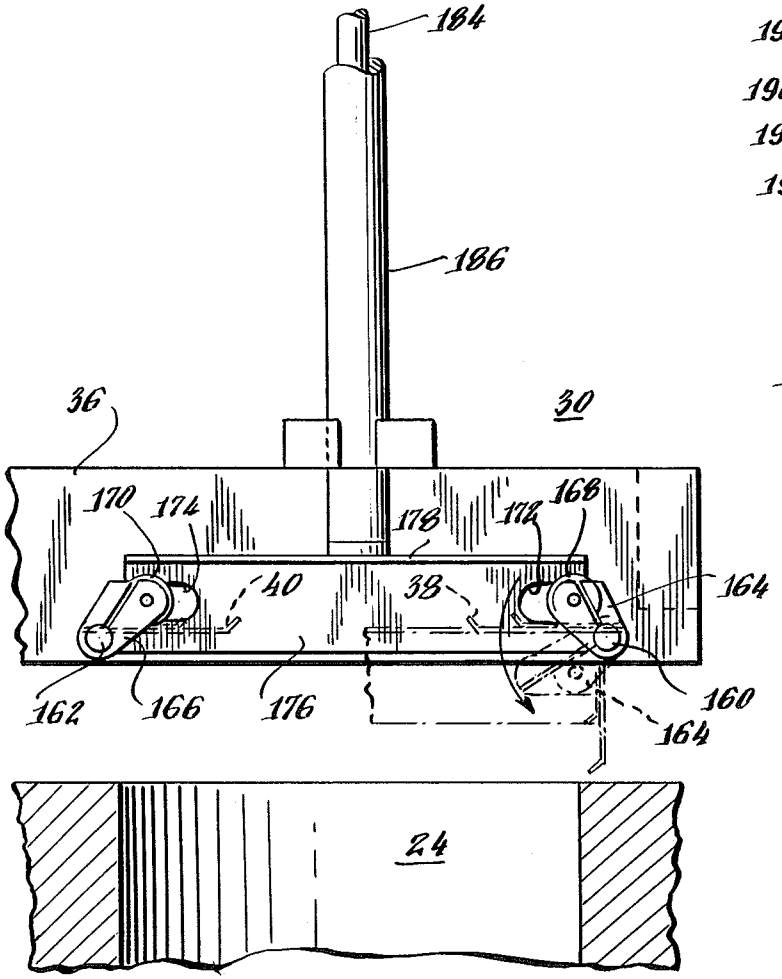
FIG. 9 is an end elevation view showing portions of the trap door mechanism.

Referring now to FIG. 9, the trap doors 38, 40 for the drop station 30 are shown to include pivot shafts 160, 162 for accommodating pivotal motion between the horizontal door position (supporting a stack of product, not shown) to a vertical position as the stack of product is passed through the drop station to a waiting receptacle. Each pivot shaft carries a crank arm 164, 166 having at its remote end a roller 168, 170 fitted into an oval horizontal slot 172, 174 in the vertical portion 176 of an L-shaped bracket generally indicated at 178 (see also FIG. 10).

The bracket 178 includes a horizontal portion 180 to which is fastened a spring 182 to apply force to the crank arms 164, 166 so as to normally maintain the trap doors 38, 40 in their horizontal position. As a stack of product is passed through the trap doors, the bracket 178 moves down against the force of the spring 182, being guided by a vertical shaft 184 sliding in a tube 186.

It will be seen in FIG. 9 that the rollers 168, 170 move laterally in their slots 172, 174 in the bracket 178 as the trap doors pivot down to load a stack of product. The constraint on the movement of the rollers caused by their engagement with these slots forces the rollers to be maintained essentially at the same level (i.e., in the same horizontal plane), thus forcing the crank arms 164, 166 to be at equal angles with respect to vertical. This in turn forces the movements of the trap doors 38, 40 to track so that the two doors will always be at the same angular inclination. This feature minimizes dislocation or disarray of the product stack as it passes through the trap doors.

The bias spring 182 also is provided with an adjustment mechanism 190 to permit ready variation of the bias force as may be required by the specific packaging operation being performed. This mechanism comprises a threaded shaft 192 having a threaded stop nut 194 near the top to set the vertical positioning of the shaft with respect to a bracket 196, thereby to set the initial bias force holding the trap doors in horizontal position. The stop nut can be screwed down the shaft to increase the spring force if required. Lock nuts 198 are provided to secure the stop nut in position.

In accordance with this invention, stacked products of relatively warm, very flexible, relatively thinly sliced luncheon meats are automatically loaded into close-fitting cup-shaped receptacles of semi-rigid plastic, without the need for hand manipulation. The repetitive loading cycle is fast and efficient and the mechanical operations are simplified to reduce machine down-time. The integrity of the stacks and their appearance are maintained through use of the mechanical motions and structures as described. The stacks are smoothly transferred from a horizontal conveyor to a downwardly inclined conveyor and then are smoothly transferred by an arcuately-curving pusher motion which shifts the stacks along a conveyor section (which also preferably is arcuately curved) so as to be positioned in proper alignment over a pair of spring-biased trap doors. These doors are constrained to provide for corresponding (i.e., equal angular movements to prevent disarray of the stack while passing through the drop station.

Since changes and modifications to fit particular operating requirements and environments will be apparent to those skilled in the art, the invention should not be considered limited to the example chosen for purposes of illustration, and rather should be understood to include all changes and modifications which do not constitute a departure from the true spirit and scope of the invention.

What is claimed is:

1. In a vacuum packaging apparatus of the type comprising means to support and move semi-rigid packaging material through a series of stations where packaging operations are performed, said stations comprising a loading station where stacks of thinly-sliced, flexible food products are to be placed in cup-shaped receptacles formed of said semi-rigid packaging material and dimensioned to provide a close fit with said stacks of product;

automatic loading apparatus for transferring said stacks of product successively into said cup-shaped receptacles without the need for human manipulation, comprising:

a drop station having pivoted trap door means normally spring-biased into horizontal position;

a downwardly-inclined conveyor having its lower end immediately adjacent said drop station and serving to convey stacks of sliced product down to said trap door means;

a pusher arm rotatably mounted above said drop station and having at its lower end a retractable pusher arranged to swing with said arm through an arcuate path forwardly over said downwardly-inclined conveyor to engage a stack of product on the lower portion thereof to shift said stack onto said trap door means;

ram means mounted directly above said trap door means and operable to be driven down to press a stack of product through said trap door means and into a waiting receptacle; and means to retract said pusher from its lower position engageable with a stack of product to an upper position wherein said pusher can be swung rearwardly above the advancing stacks of product to permit said pusher to be shifted back down between the next set of stacks so as to be swept forward again to engage and transport another stack to said trap door means.

2. Apparatus as claimed in claim 1, wherein said downwardly-inclined conveyor comprises moving means to carry the stacks of product down towards said drop station.

3. Apparatus as claimed in claim 2, wherein said moving means comprises flexible belt means.

4. Apparatus as claimed in claim 1, wherein said downwardly-inclined conveyor comprises a curved portion at its lower end to at least approximately match the curvature of the path of said pusher as it moves said stacks from said conveyor to said horizontal trap door means.

5. Apparatus as claimed in claim 4, including a second conveyor feeding said stacks of product horizontally to the top of said downwardly-inclined conveyor.

6. Apparatus as claimed in claim 5, wherein the top of said downwardly-inclined conveyor is at least slightly curved to provide for smooth transfer of said product stacks between said conveyors.

7. Apparatus as claimed in claim 1, wherein said trap door means comprises a pair of side-by-side trap doors pivotally mounted along their outside slopes; and means to effect coordinated pivotal movement of said trap doors while a stack of product is being passed therethrough, to assure that the angles of said trap doors remain substantially equal as loading proceeds.

8. Apparatus as claimed in claim 7, wherein said means to effect coordinated pivotal movement comprises a bracket plate; and means to couple each of said trap doors to said plate to assure that the trap door angles are equal.

9. Apparatus as claimed in claim 1, including bias-spring means coupled to said trap door means to hold it in horizontal position; and readily-accessible adjustment means for changing the spring means produced by said spring means.

10. A packaging loader apparatus for automatically loading stacks of sliced food products into a movable series of package receptacles at a loading station having a first conveyor adapted to receive and move stacks of sliced food product comprising:

a horizontal drop station at said loading station positioned over and aligned with said package receptacles as said package receptacles are moved horizontally through said loading station under said drop station;

a downwardly-inclined conveyor for transporting said stacks of sliced food products fed from said first conveyor on a downwardly inclined path to said drop station;

a pusher arm having a retractable pusher mounted thereon adapted to engage and sweep a stack of sliced product off of the lower end of said downwardly-inclined conveyor and into said drop station when said pusher is in a lowered position behind said stack of sliced product;

a pusher arm drive means for oscillating said pusher arm in a predetermined arcuate path;

pusher control means for lowering said pusher directly behind a stack or retracting said pusher above said stacked product after said sliced product has been moved into said drop station;

ram means movably mounted in said drop station and normally situated in an initial inactive position over said drop station above said sliced product when such product has been swept therein by said pusher; and ram drive means actuating said ram means for forcing said stack of sliced product through said drop station and into said package receptacle and thereafter returning said ram means to its initial inactive position.

11. The packaging loader apparatus as claimed in claim 10, wherein said downwardly-inclined conveyor comprises moving transmission belt means for moving each stack of sliced food product to a position adjacent said drop station.

12. The packaging loader apparatus as claimed in claim 10, wherein said ram drive means and said pusher arm drive means both comprise cam means to effect positive drive of said ram and said pusher arm, thereby to assure precisely-controlled movements to achieve reliable loading of said stacks.

13. The packaging loader apparatus as claimed in claim 12, in which said pusher arm drive means includes a pusher arm cam, a pusher arm cam follower having a crank lever coupled thereto and driven thereby, a crank lever rod coupled to and moved by said crank lever, and means for coupling said crank lever rod to said pusher arm for oscillating said arm to-and-fro under the control of said pusher arm cam.

14. The packaging loader apparatus as claimed in claim 12, wherein said ram drive means includes a ram cam and ram cam follower, a pivoting crank arm driven by said ram cam follower, a rod coupled to and driven by said pivoting crank arm, a rocker arm coupled to said rod, and means for coupling said rocker arm to said ram for moving said ram up and down in said drop station under the control of said ram cam.

15. The packaging loader apparatus as claimed in claim 12, in which said pusher arm drive means, said pusher control means and said ram drive means are all controlled from a common drive shaft.

16. The packaging loader apparatus as claimed in claim 15, having a pusher arm cam, a pusher cam and a ram cam driven by said common drive shaft for controlling said pusher arm, said pusher and said ram, respectively.

17. A method of loading stacks of sliced food product into successive package receptacles moving through a loading station, comprising the steps of:

moving the stacks of sliced product to be packaged on a downwardly inclined path to a horizontal drop station in said loading station;

sweeping said stacks individually with an arcuately moving pusher from the lower end of said downwardly inclined path and into said drop station;

intermittently moving said series of package receptacles horizontally under said drop station and aligning the cavities of said receptacles with said drop station during a dwell period;

ramming the stack from the drop station into the cavity of the waiting receptacle;

as the stack is being rammed, retracting the pusher and returning it back to the position corresponding to the start of the sweeping of the stack; and lowering the retracted pusher behind a subsequent stack on said inclined path and initiating another sweeping action to repeat the aforesaid steps to thereby continue to load stacked sliced food products into cavities of the receptacles.

18. The packaging loader apparatus as claimed in claim 14, having a motion sensor mounted on said rod for detecting and generating a signal on the occurence of relative motion between said sensor and said rocker arm thereby indicating that the mechanism is jammed which signal is adapted to stop said apparatus.

19. In vacuum packaging apparatus of the type comprising means to support and move a series of semi-rigid package receptacles through a series of stations, said movement being intermittent and providing a dwell time for carrying out packaging operations, one of said stations comprising a loading station where stacks of thinly-sliced, flexible food products are placed in said receptacles;

automatic loading apparatus for transferring said stacks of products successively into said receptacles comprising:

a horizontal drop station;

a downwardly-inclined conveyor having its lower end immediately adjacent said drop station and serving to convey stacks of sliced product thereto;

a pusher arm rotatably mounted above said drop station and having at its lower end a retractable pusher arranged to swing with said arm through an arcuate path forwardly over said downwardly-inclined conveyor to engage a stack of product on the lower portion thereof to shift said stack onto said trap door means;

ram means mounted directly above said trap door means and operable to be driven down to press a stack of product through said trap door means and into a waiting receptacle;

means to retract said pusher from its lower position engageable with a stack of product to an upper position wherein said pusher can be swung rearwardly above the advancing stacks of product to permit said pusher to be shifted back down between the next set of stacks so as to be swept forward again to engage and transport another stack to said trap door means; and means to drive said conveyor at a speed greater than the average speed of advance of said package receptacles, whereby to permit said stacks to be separated by a greater distance than said receptacles, thereby to permit said pusher to more easily be positioned between successive stacks.

20. A method of loading stacks of sliced food product into successive package receptacles moving through a loading station comprising the steps of:

placing the stacks of sliced product to be packaged on a downwardly inclined conveyor leading to a horizontal drop station in said loading station;

said stacks on said conveyor being separated by a center-to-center spacing greater than the center-to-center spacing of said receptacles;

sweeping said stacks individually with an arcuately-moving pusher from the lower end of said downwardly inclined conveyor and into said drop station;

intermittently moving said series of package receptacles horizontally under said drop station;

operating said conveyor at a speed greater than the average speed of said receptacles to provide for synchronizing the arrival of said receptacles at said drop station;

ramming the stack from the drop station into the cavity of the waiting receptacle;

as the stack is being rammed, retracting the pusher and returning it back to the position corresponding to the start of the sweeping of the stack; and lowering the retracted pusher behind a subsequent stack on said inclined path and initiating another sweeping action to repeat the aforesaid steps to thereby continue to load stacked sliced food products into cavities of the receptacles.

21. A packaging loader apparatus for automatically loading stacks of sliced food products into a movable series of package receptacles at a loading station having a first conveyor adapted to receive and move stacks of sliced food product comprising:

a horizontal drop station at said loading station positioned over and aligned with said package receptacles as said package receptacles are moved horizontally through said loading station under said drop station;

a downwardly-inclined conveyor for transporting said stacks of sliced food products fed from said first conveyor on a downwardly inclined path to said drop station;

a pusher mounted above said drop station;

pusher drive and control means for oscillating said pusher in a predetermined path wherein said pusher first is lowered directly behind a stack of product on the lower end of said downwardly-inclined conveyor and thereafter is swept along a first arcuate path segment from said downwardly-inclined conveyor to said horizontal drop station to position the stack in said drop station, and thereafter is moved back along a second path segment above said first path segment to a position above said stacks of product on said downwardly-inclined conveyor from which it can again be lowered directly behind the next successive stack of product to be swept again along said first arcuate path segment;

ram means movably mounted in said drop station and normally situated in an initial inactive position over said drop station above a stack of product when such stack has been swept therein by said pusher; and ram drive means actuating said ram means for forcing said stack of sliced product through said drop station and into said package receptacle and thereafter return said ram means to its initial inactive position.

22. A packaging loader apparatus for automatically loading stacks of sliced food products into a movable series of package receptacles at a loading station having a first conveyor adapted to receive and move stacks of sliced food product comprising:

a horizontal drop station at said loading station positioned over and aligned with said package receptacles as said package receptacles are moved horizontally through said loading station under said drop station;

a downwardly-inclined auto-loader for transporting said stacks of sliced food products fed from said first conveyor on a downwardly inclined path to said drop station;

a pusher arm having a retractable pusher mounted thereon adapted to engage and sweep a stack of sliced product off of said downwardly inclined auto-loader into said drop station when said pusher is in a lowered position behind said stacks of sliced product;

a pusher arm drive means for oscillating said pusher arm in a predetermined arcuate path;

pusher control means for lowering said pusher directly behind a stack or retracting said pusher above said stacked product after said sliced product is moved into said drop station;

ram means movably mounted in said drop station and normally situated in an initial inactive position over said drop station above said sliced product when such product is swept therein by said pusher;

and ram drive means actuating said ram means for forcing said stack of sliced product out of said drop station and into said package receptacle and returning said ram means to its initial inactive position.

23. A method of loading stacks of sliced food product in cavities in a series of packing receptacles in a loading station comprising the steps of:

moving the stacks of sliced product to be packaged on a downwardly inclined path to a horizontal drop station in said loading station;

sweeping said stacks individually with an arcuately moving pusher arm having a retractable pusher thereon from said downwardly inclined path into said drop station, intermittently moving said series of packaging receptacles horizontally under said drop station and aligning the cavities in said receptacles with said drop station;

retracting the retractable pusher and returning the arcuately moving pusher arm back to the position corresponding to the start of the sweeping of the stack;

ramming the stack into the cavity of the receptacle;

lowering the retracted pusher behind a subsequent stack on said inclined path and initiating another sweeping action and repeating the aforesaid steps to thereby continue to load stacked sliced food products into cavities of receptacles.

* * * * *